United States Patent [19]

Sedlaczek

[11] 4,103,635

[45] Aug. 1, 1978

[54] METHOD FOR MAKING TUFTED GOODS

[75] Inventor: Richard Sedlaczek, Wels, Austria

[73] Assignee: Edgar Pickering (Blackburn) Limited, Blackburn, England

[21] Appl. No.: 690,030

[22] Filed: May 25, 1976

[30] Foreign Application Priority Data

May 26, 1975 [AT] Austria ..... 3967/75

[51] Int. Cl.[2] ..... D05C 3/00; D05C 15/00

[52] U.S. Cl. ..... 112/266; 112/79R

[58] Field of Search ..... 112/79 R, 79 A, 266, 112/410, 411, 219 A, 220, 78, 262

[56] References Cited

U.S. PATENT DOCUMENTS

| | | | |
|---|---|---|---|
| 3,529,560 | 9/1970 | Jackson | 112/79 R |
| 3,548,766 | 12/1970 | Colbert | 112/79 R |
| 3,597,672 | 8/1971 | Seesselberg et al. | 112/220 |
| 3,762,346 | 10/1973 | Cobble | 112/79 R |

*Primary Examiner*—H. Hampton Hunter

*Attorney, Agent, or Firm*—Kurt Kelman

[57] ABSTRACT

Stop spots in pile fabrics are avoided in the manufacture of loop and cut pile fabrics by continuously reducing the operating speed of the needle drive shaft before the machine is stopped, when such stoppage becomes necessary in the course of the fabric manufacture, and again continuously increasing the shaft operating speed to its normal value after start-up.

4 Claims, 4 Drawing Figures

METHOD FOR MAKING TUFTED GOODS

Figure 1:
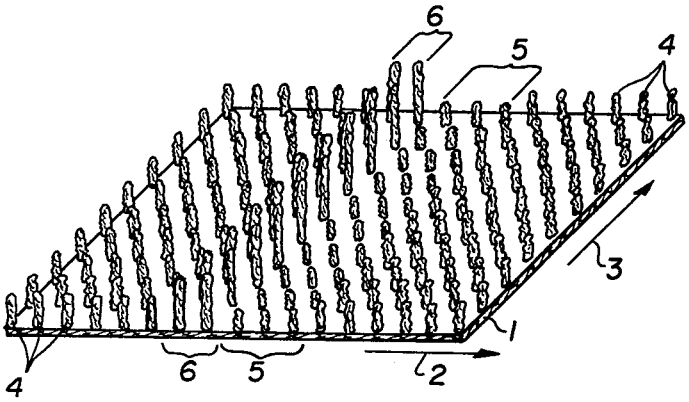

The invention relates to a method for the manufacture of tufted fabric, in which method the operating speed is first reduced to a lower value and the machine is then stopped in case it becomes necessary to stop the machine during the manufacture of a piece of fabric.

In the manufacture of tufted fabric, the necessity arises from time to time during the manufacturing operation, in case of yarn breakage or when yarn runs out, to discontinue operation of the tufting machine used and to re-establish proper yarn delivery to the needles, whereupon the manufacturing process is continued by placing the machine in operation again.

However, defects occur in the manufactured fabric when the tufting machines are stopped. These defects are readily visible and are not removed by subsequent treatment, such as shearing, dyeing, printing, etc. These defects are called stop spots.

The cause for the appearance of stop spots in tufted fabrics resides primarily in the relatively abrupt reduction of the operating speed of tufting machines, which heretofore have preponderately been provided with a drive with a constant rotary speed, such as a three-phase squirrel cage motor. The use of an additional auxiliary drive with a rotary speed below that of the constant speed main drive, the main drive being disconnected first when the machine is stopped and the auxiliary drive operating the machine at a lower speed, in practice does not prevent appearance of the disturbing stop spots, either.

It is an object of the present invention to prevent in a simple manner the appearance of stop spots in loop pile and cut pile in velour. The method of the invention is characterized in that the operating speed of the needle driving shaft is reduced continuously and that, at the start-up of the manufacturing process following the stoppage, the operating speed is again continuously increased to the desired value. It has been shown that this can prevent the appearance of stop spots in pile fabric and that the above object can be well achieved with these measures. In the present context, the term "continuously" is understood to mean a stepless change in speed as well as a change in speed whose continuity is approached by a multiplicity of small steps.

It is advantageous for the rapidity of the manufacturing process as well as for the good appearance of the manufactured fabric to provide for the reduction and the increase in the operating speed to proceed within a short period of time, i.e. within 10 seconds. It is also advantageous to provide for the time intervals during which, at stopping and start-up, very low operating speed is used to be less than 10 seconds, preferably 2 to 3 seconds.

The tufting machine has a drive whose rotary speed is adjustable continuously from a desired operating speed to a considerably lower speed.

Figure 2:
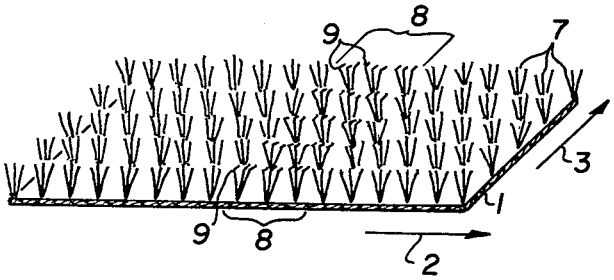
Figure 4:
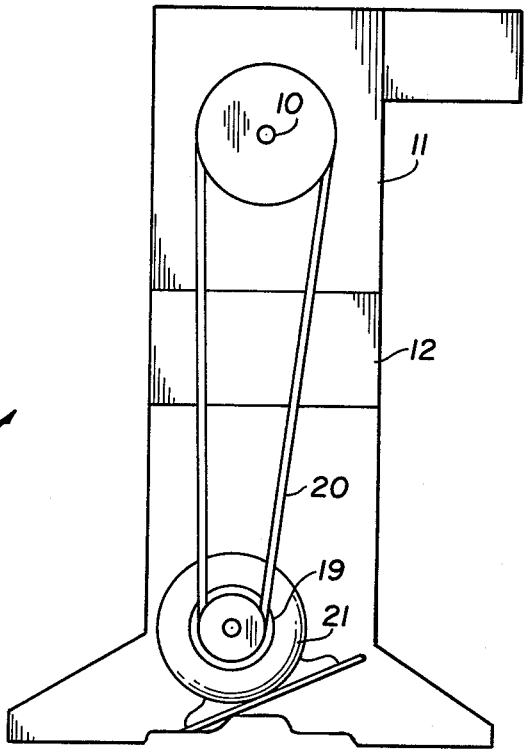
Figure 3:
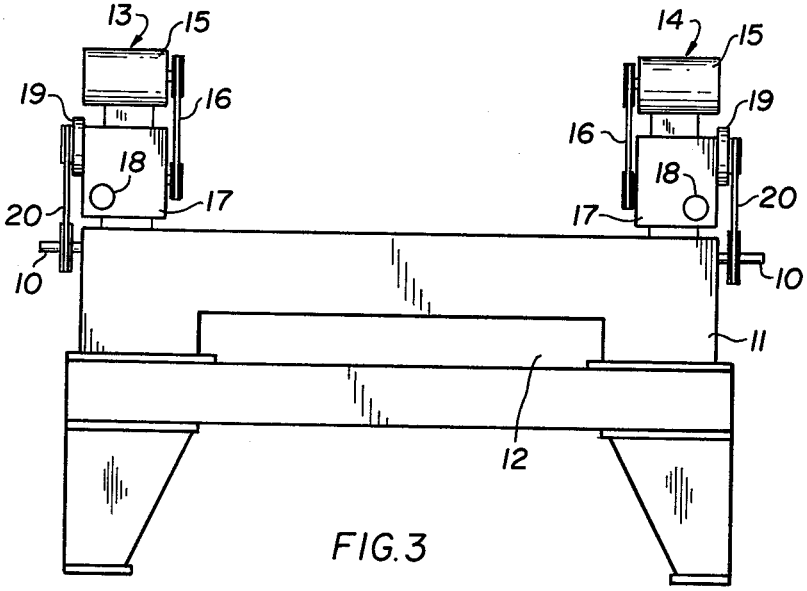

The invention will be explained further in connection with embodiments illustrated in the drawing. In the drawing:

FIG. 1 shows schematically a piece of loop pile fabric, in which a stop spot is present, FIG. 2 shows schematically a piece of cut pile fabric, in which a stop spot is present, FIG. 3 schematically shows one embodiment of a tufting machine, whose drive is provided with an infinitely variable transmission, and FIG. 4 schematically shows another embodiment of a tufting machine whose drive is provided with a variable-speed motor.

Pile fabric of which a piece is illustrated in FIG. 1 is manufactured by passing a foundation material 1, for instance a jute web, in the direction of arrow 2 through a tufting machine which has a large number of needles which are arranged side-by-side in the direction of arrow 3 indicating the width of the fabric. During the advance of the foundation material in the direction of arrow 2, loops 4 of yarn delivered to the above-mentioned needles are formed by continuously punching the needles of the tufting machine through the foundation material. If the operation of the tufting machine, whose main shaft is normally operated at 500 to 700 rpm, is stopped simply by disconnecting the drive, a few sequential rows 5 of loops 4 of reduced height are produced due to the resulting sudden change in the tension of the yarn. When the machine is later started up with its full operating speed, one or two rows 6 of loops markedly higher than loops 4, which are produced during the normal operation, are formed before the normal operation of the machine is resumed. It is obvious that the defects shown in FIG. 1, and which are called stop spots, considerably reduce the quality of the fabric and, if recurring frequently, make the fabric useless. Such defects became visible particularly when such carpet fabrics are subjected to distortions during laying and the rows of loops run arcuately.

If according to the invention a continuous reduction of the operating speed to a small value is used to stop the machine, the reduction being effected, for example, within 10 seconds, and the operating speed is increased again continuously to the desired value after the machine has been stopped to repair the breakdown (such as, for example, yarn breakage), the appearance of loop rows 5, 6, wherein loops 4 have a height deviating from the norm, may be avoided and defects of the type shown in FIG. 1 will accordingly no longer occur. It is advantageous to limit the time intervals during which the machine is worked at very low speeds, at the stoppage and start-up, to about 2 to 3 seconds.

In the manufacture of pile fabric it is advantageous in many instances to reduce the rotary speed of a machine operating at about 500 to 700 r.p.m. continuously to about 59 r.p.m. and then stop the machine, and start-up again at about 50 r.p.m. and then continuously to return to the working rotary speed which is at about 500 to 700 r.p.m.

For the manufacture of velour fabric of which a piece is illustrated in FIG. 2, a foundation material 1 is again passed through a tufting machine in the direction of arrow 2 and is provided with loops of yarn delivered to the needles of the tufting machine which are arranged side-by-side along arrow 3. The loops are then cut in the manufacture of velour fabric so that tufts 7 are produced, which project from foundation material 1. In the manufacture of velour fabric, a length of yarn corresponding to about 3 loops is always present at the yarn gripping means of the tufting machine and, in these loops, the respective thread is highly tensioned about the yarn gripping means edge. When the machine is stopped, bends, are created in the thread because the thread remains under high tension held at the same location for an extended period of time on the yarn gripping means, and these bends remain visible even after cutting of the loops. Thus, a series of rows 8 appear in the velour fabric wherein the tufts have bends 9 which have a very unfavorable visible effect. These rows are called stop spots in velour fabrics. The intensity of the bends and thus the visibility of the stop spots depends on the extent of the bends which, in turn, depends on the length of the stoppage.

The appearance of such visible bends 9 may be counteracted by the method of the invention, and for this purpose the operating speed of the machine is first continuously reduced to a very small value, for example 5 to 10 r.p.m., at which slow operating speed it is possible to advance the broken yarn to the needle. It is then only necessary to thread the yarn through the needle, and for this purpose a very short period of stoppage of the machine is sufficient during which no bends are permanently fixed in the yarns. Afterwards, the operating speed is again increased continuously to the norm. Such an operating procedure may be followed quite simply with a machine wherein the rotary speed of an infinitely variable transmission provided on the machine is adjustable to a zero rotary speed.

The tufting machine shown in FIG. 3 comprises, as usual, a main driving shaft 10 which is journaled in machine frame 11 and which moves the needles of the machine, which are not illustrated. A foundation material, which is passed through bed 12 of the machine, is provided with loops by means of these needles (see FIG. 1). The main drive shaft 10 of the machine is rotated by two drive units 13 and 14. Each of these drive units has a threephase squirrel cage motor 15 of substantially constant rotary speed and the motor is connected by V-belt drive 16 to infinitely variable transmission 17. The transmission ratio of the transmission is adjustable by control element 18. An electrical brake 19 is arranged at the output side of infinitely variable transmission 17 and a further V-belt drive 20 connects transmission 17 with main drive shaft 10.

Hydraulic transmissions and friction couplings, such as for example adjustable belt drives, are particularly useful as variable transmissions.

In the tufting machine schematically shown in FIG. 4, which is a side view, there is also provided a main drive shaft 10 which is journaled in frame 11 of the machine. The non-illustrated needles with which the foundation material is guided through bed 12 of the machine and is provided with loops are moved by this main drive shaft. The drive of the tufting machine illustrated in FIG. 4 has a variable speed motor 21 which is connected to main drive shaft 10 of the machine by V-belt drive 20. An electrical brake 19 is also associated with the drive shaft of variable speed motor 21. The variable speed motor 21 is preferably an electric or a hydraulic variable speed motor.

I claim:

1. In a method for the manufacture of a pile fabric, wherein a rotary drive shaft is driven at a normal operating speed to operate needles punching yarns through a foundation for forming yarn loops thereon, and the rotation of the shaft is stopped in case of yarn breakage, the steps of continuously reducing the rotary speed of the shaft from the normal operating speed to a low speed before it is stopped from the low speed and then, after repair of the yarn breakage, restarting the shaft rotation at the low speed and thereafter continuously increasing the rotary speed of the shaft to the normal operating speed.

2. In the method of claim 1, wherein the continuous reduction and increase in the rotary speed of the drive shaft are effected within a time interval of the order of 10 seconds.

3. In the method of claim 1, wherein the fabric is a loop pile fabric, the normal operating speed of the drive shaft is reduced continuously to about 50 r.p.m. before the rotation of the shaft is stopped, the rotation of the shaft is started up at about 50 r.p.m. and then continuously increased to the normal operating speed.

4. In the method of claim 1, wherein the fabric is a cut loop fabric, the normal operating speed of the drive shaft is reduced continuously to about 5 to 10 r.p.m., the broken yarn is then advanced to its needle and the rotation of the shaft is then briefly stopped while the broken yarn is threaded through its needle before it is started up again.

* * * * *